US007438556B2

(12) United States Patent
Yi

(10) Patent No.: US 7,438,556 B2
(45) Date of Patent: Oct. 21, 2008

(54) ELECTRICAL INTERCONNECTION BETWEEN MULTIPLE PRINTED CIRCUIT BOARDS

(75) Inventor: Chong Yi, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/801,978

(22) Filed: May 10, 2007

(65) Prior Publication Data

US 2008/0045044 A1 Feb. 21, 2008

Related U.S. Application Data

(63) Continuation-in-part of application No. 11/504,337, filed on Aug. 15, 2006.

(51) Int. Cl.
*H01R 12/00* (2006.01)

(52) U.S. Cl. ..... 439/61; 439/65; 439/637

(58) Field of Classification Search ..... 439/61, 439/65, 637; 361/788, 796
See application file for complete search history.

(56) References Cited

U.S. PATENT DOCUMENTS 3,328,646 A * 6/1967 Caillat ..... 361/796
4,603,928 A * 8/1986 Evans ..... 439/61
5,190,462 A * 3/1993 Lauchner et al. ..... 439/65
5,283,851 A * 2/1994 Vergnolle ..... 385/134
5,352,123 A * 10/1994 Sample et al. ..... 439/61
5,356,301 A 10/1994 Champion et al.
5,402,078 A * 3/1995 Hamilton ..... 324/760
5,863,211 A * 1/1999 Sobotta et al. ..... 439/74
5,993,259 A 11/1999 Stokoe et al.
6,083,047 A 7/2000 Paagman
6,392,142 B1 * 5/2002 Uzuka et al. ..... 439/65
6,422,876 B1 * 7/2002 Fitzgerald et al. ..... 439/61
6,866,518 B1 * 3/2005 Korsunsky et al. ..... 439/61
6,918,775 B2 7/2005 Korsunsky et al.
6,923,655 B2 * 8/2005 Korsunsky et al. ..... 439/65
7,108,556 B2 9/2006 Cohen et al.
7,354,274 B2 * 4/2008 Minich ..... 439/65

* cited by examiner

*Primary Examiner*—Briggitte R Hammond
(74) *Attorney, Agent, or Firm*—Wei Te Chung

(57) ABSTRACT

An electrical interconnection system includes a stationary board (200), a removable board (300) having a number of conductive pads (304-306), and a connector (100). The connector includes an insulative housing (1) defining thereon a number of passageways (121, 122), a number of contacts (2) retained in the passageways. The contacts include a number of first contacts (21) each having a first contacting end (21*b*) and a number of second contacts (22) each having a second contacting end (22*b*). The first and the second contacting ends are offset from each other and come to contact with corresponding conductive pads in sequence.

20 Claims, 13 Drawing Sheets

ELECTRICAL INTERCONNECTION BETWEEN MULTIPLE PRINTED CIRCUIT BOARDS

CROSS-REFERENCE TO RELATED APPLICATIONS

This patent application is a continuation-in-part of a pending U.S. patent application Ser. No. 11/504,337, filed on Aug. 15, 2006, and entitled "ELECTRICAL INTERCONNECTION BETWEEN MULTIPLE PRINTED CIRCUIT BOARDS", which is invented by the same inventor as this patent application and assigned to the same assignee with this application.

BACKGROUND OF THE INVENTION

1. Field of the Invention

The present invention generally relates to an electrical interconnection, and more particularly to an interconnection within an electrical system in which a plurality of stationary boards and a plurality of removable boards are installed and arranged in a matrix form.

2. Description of Related Art

Various electronic systems, especially a telecommunication system, router, server and switch, comprise a wide array of components mounted on printed circuit boards, such as daughter boards and motherboards. The mother board to which the daughter boards are connected is generally referred to as backplane as it is stationary. Connectors used to assemble the daughterboards, which are removable, to the motherboards are referred to as backplane connectors. The mother board and the daughter board are interconnected by the connectors so as to transfer signals or power throughout the systems.

Typically, the motherboard, or backplane, is a printed circuit board that is mounted in a server or a switch and is provided with a plurality of backplane connectors. Multiple daughterboards are also each provided with a mating connector and then removably plugged into the connectors on the backplane. All the daughterboards are interconnected to the backplane, the daughterboards are interconnected through the backplane and are arranged parallel to each other.

However, connecting the daughterboards via the backplane leads to the potential for signal interference. Because the daughterboards are all connected via the backplane, signal strength may be attenuated as signals travel through the backplane. In general, signals passing between two daughterboards pass through at least a first connector pair between a first daughter board and the backplane, and a second connector pair between the backplane and a second daughter board. In general, the signal passes through a total of two pairs of mated connectors, and each time the signal is attenuated as it passes.

Generally, the arrangement between the backplane and the daughter board can be referred to as a "TTTT" type viewed from a top, i.e. the backplane is arranged in a horizontal direction, while the daughter board is arranged in a position perpendicular to the backplane. In some cases, both sides of the backplane are provided with connectors for assembling the daughterboards from both sides. This arrangement can be referred to as a "++++" type viewed from a top. In this arrangement, the daughterboards arranged in both sides are in communication with each other through the motherboard, i.e., mid-plane.

Many connectors have been provided for achieving such arrangement. U.S. Pat. No. 5,993,259 (the '259 patent) issued to Stokoe et al. discloses an electrical connector of such application. The connector disclosed in the '259 patent includes a plurality of modularized wafers bounded together. As shown in FIG. 4 of the '259 patent, the terminals are stamped from a metal sheet and then embedded within insulative material to form the wafer.

U.S. Pat. No. 6,083,047 issued to Paagman discloses an approach to make a high-density connector by introducing the use of printed circuit boards. Conductive traces are formed on surfaces of the printed circuit board in a mirror-image arrangement.

U.S. Pat. No. 7,108,556 issued to Cohen et al. discloses a similar configuration.

U.S. Pat. No. 5,356,301 issued to Champion et al. discloses a pair of back-to-back arranged plug connectors mounted on opposite sides of a motherboard via common contacts for respectively connecting with a receptacle connector mounted on a daughter board and a cable connector.

However, all connectors suggested above are all mounted on the backplane or mid-plane. As can be understood, if the mid-plane can be eliminated such that the daughterboards can be interconnected with each other through as few connectors as possible, then the signal attenuation as well as the interference can be largely reduced. However, none of the connectors provided yet meets such a requirement.

U.S. Pat. No. 6,918,775 (the '775 patent) issued on Jul. 19, 2005 discloses eliminating the mid-plane. A connector disclosed in the '775 patent could interconnect a stationary board and a removable board, under a cooperation between an actuator and a plurality of contacts. A plurality of first ends and second ends of the contacts electrically abut against a plurality of conductive pads of the stationary board and the removable board, respectively, for delivering signals.

However, when the connector is electrically connected to different types of signals, the signals could not be transmitted in sequence.

Hence, an improved electrical interconnection system is required to overcome the above-mentioned disadvantages of the related art.

BRIEF SUMMARY OF THE INVENTION

Accordingly, it is an object of the present invention to provide an electrical interconnection system capable of transmitting different types of signals in sequence between a pair of orthogonal boards, particularly within a connector mounted on one of the two boards.

It is another object of the present invention to provide an electrical interconnection system capable of transmitting current sequencing equally.

In order to achieve the objects set forth, an electrical interconnection system in accordance with the present invention comprises a stationary board, a removable board having a plurality of conductive pads, a driving member and a connector. The connector comprises an insulative housing defining a plurality of passageways, and a plurality contacts retained in the passageways. The contacts comprise a plurality of first contacts each having a first contacting end and a plurality of second contacts each having a second contacting end. Each contact has an engaging end contacting with the stationary board. The first contact has a first path defined between the first contacting end and corresponding engaging end. The second contact has a second path defined between the second contacting end and corresponding engaging end. The first and second paths respectively have equal lengths. The conductive pads comprise a first and a second conductive pads arranged along a cross connecting direction into two rows offset from each other a first distance. The first and second contacting ends are arranged along the cross connecting direction into two rows offset a second distance longer than the first distance. The first and second contacting ends thereby come to contact with corresponding first and second conductive pads in sequence, when the removable board is inserted towards the stationary board along the cross connecting direction.

The first and the second contacting ends are offset from each other and come to contact with corresponding conductive pads in sequence, to thereby transmit corresponding signals in sequence. Additionally, the first and second paths respectively of equal lengths are capable of transmitting corresponding signals in synchronization.

Other objects, advantages and novel features of the invention will become more apparent from the following detailed description of the present embodiment when taken in conjunction with the accompanying drawings.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE PREFERRED EMBODIMENT

Figure 1:
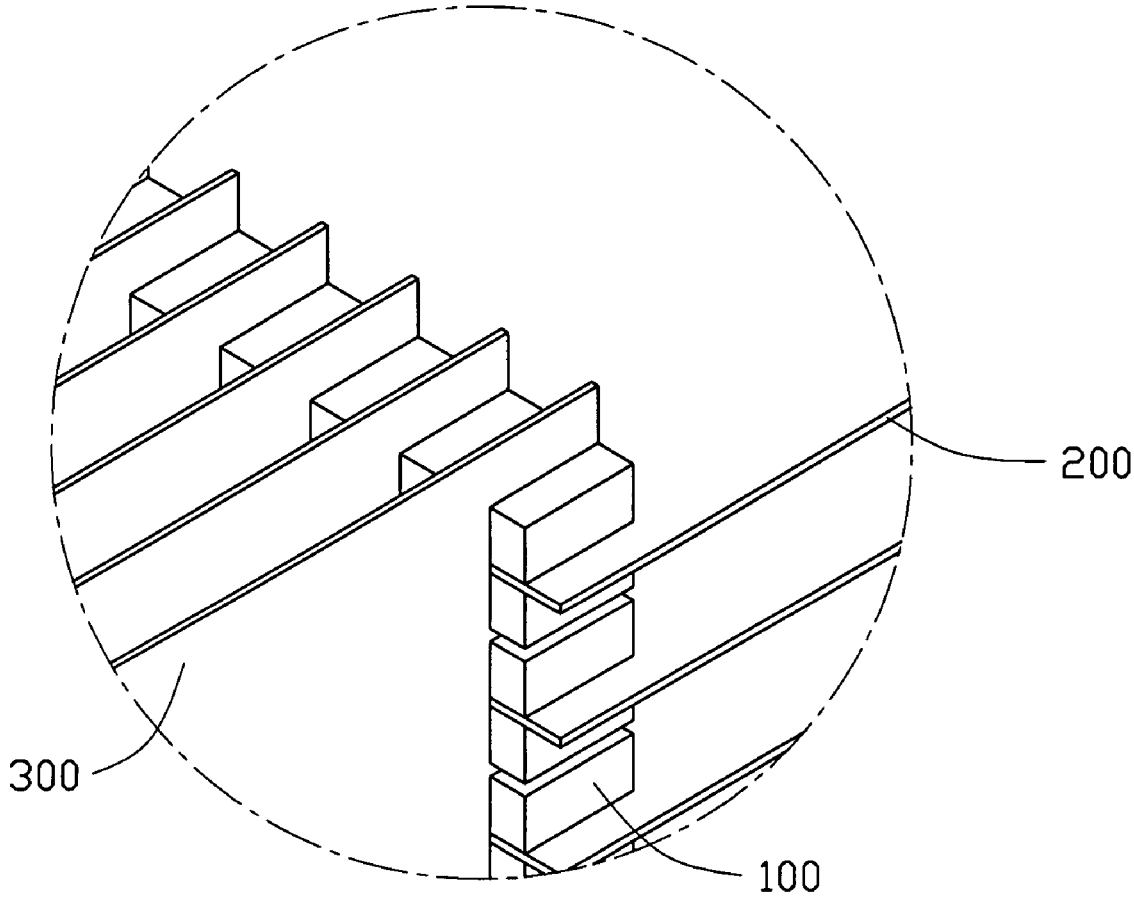
FIG. 1 is a perspective view of an electrical interconnection system in accordance with the present invention comprising a plurality of electrical connectors interconnecting stationary cards and removable cards.

Reference will now be made to the drawing figures to describe the present invention in detail.

Figure 2:
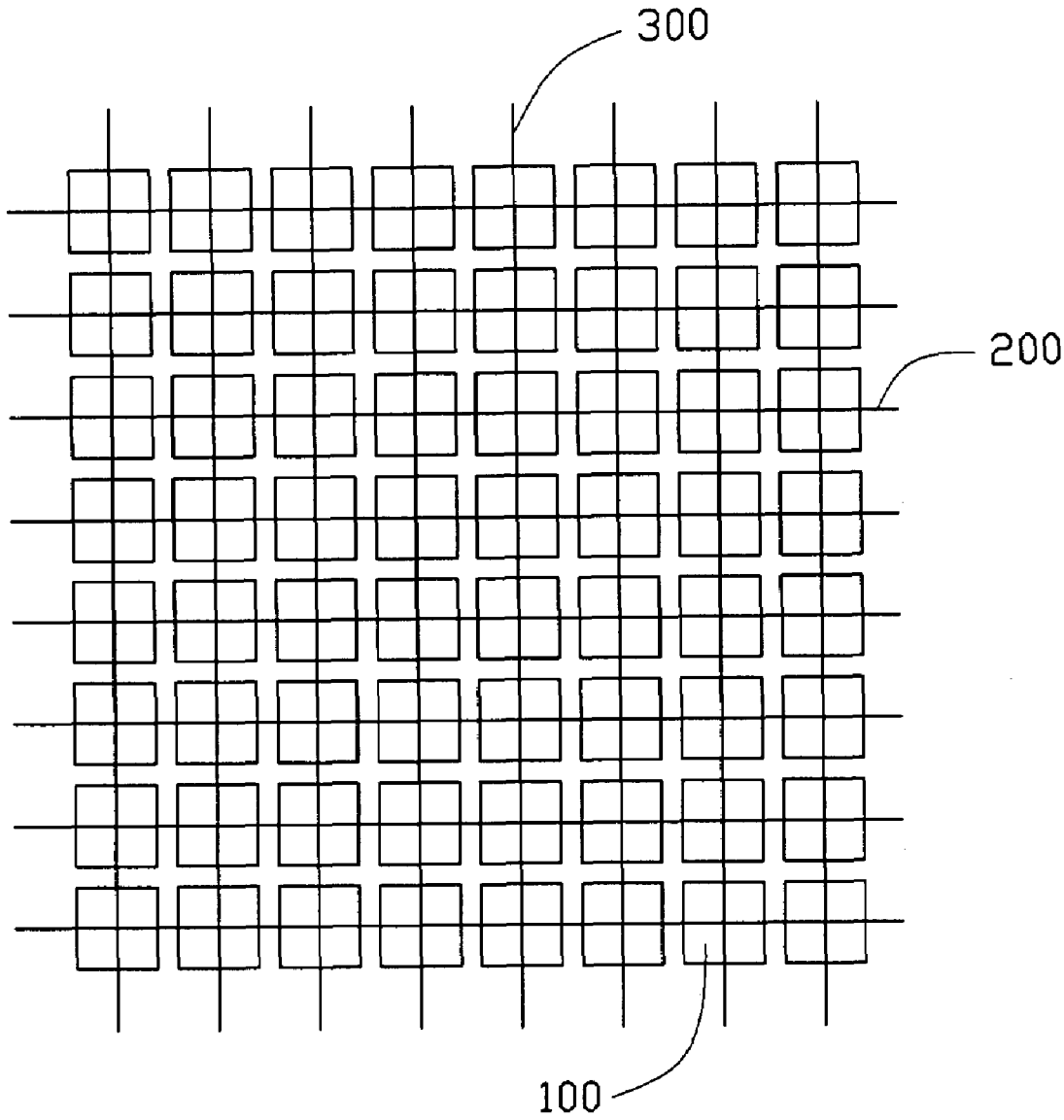
FIG. 2 is a schematic view showing the electrical interconnection system.
Figure 3:
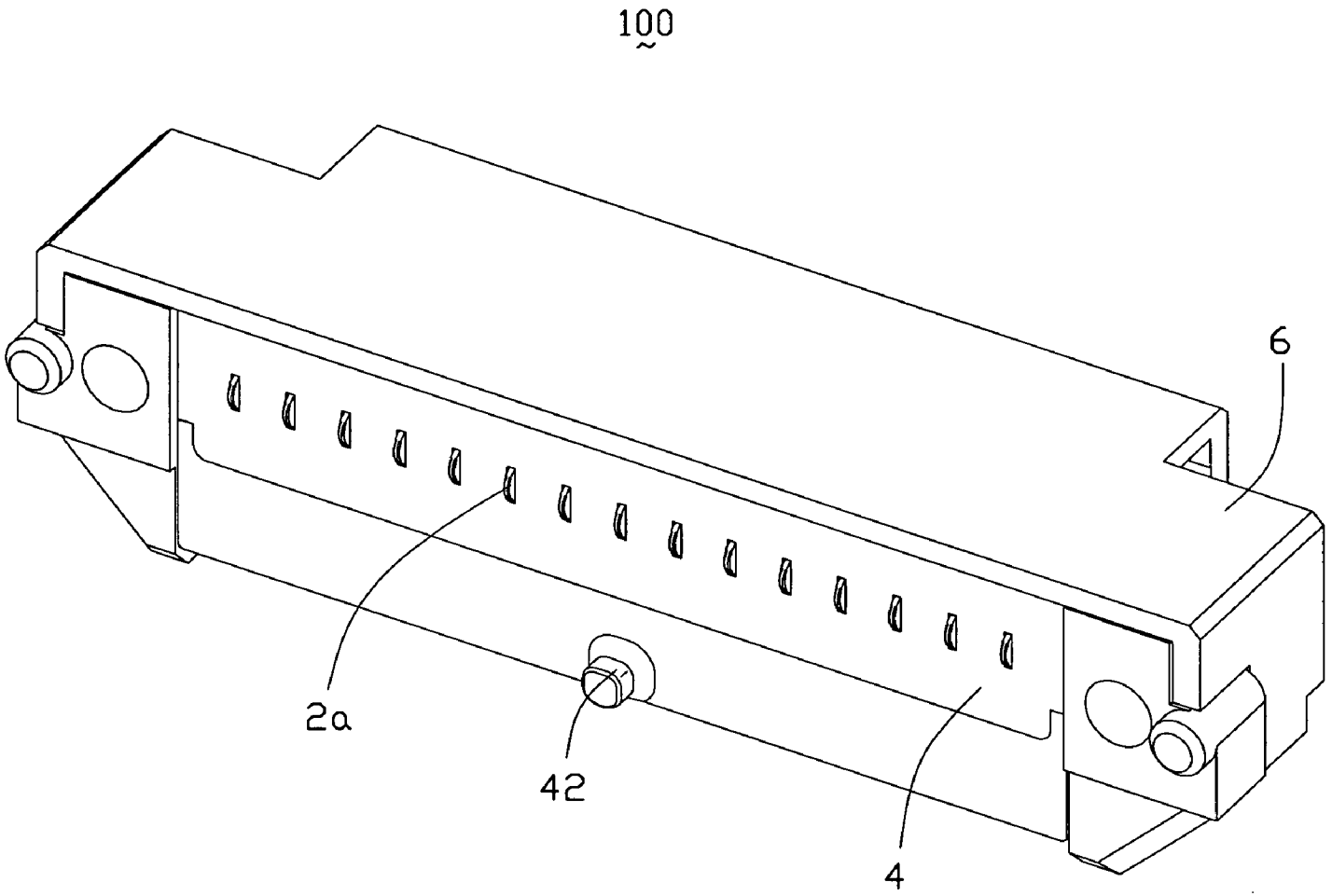
FIG. 3 is an assembled perspective view showing the electrical connector in accordance with a first embodiment before interconnecting a stationary card and a removable card.

Referring to FIGS. 1-2, a plurality of horizontal boards 200 and a plurality of vertical boards 300 are intersected with each other, which form a plurality of quadrants therebetween. For illustration purpose, the horizontal board 200 with the connectors mounted thereon is hereinafter referred to as "stationary card/board", while the vertical board 300 is referred to as "removable card/board". A plurality of electrical connectors 100 are employed in at least some of the quadrants to electrically connect the stationary card 200 and the removable card 300. It should be noted that either card type 200 or type 300 may be independently removable from the system.

One examplary electrical connector 100 in accordance with a first embodiment of the present invention, is detailedly shown in FIGS. 3-13. The electrical connector 100 comprises an insulative housing 1, a plurality of contacts 2, a spacer 3, an actuation plate 4, a resilient portion 5, and a shell 6.

Figure 4:
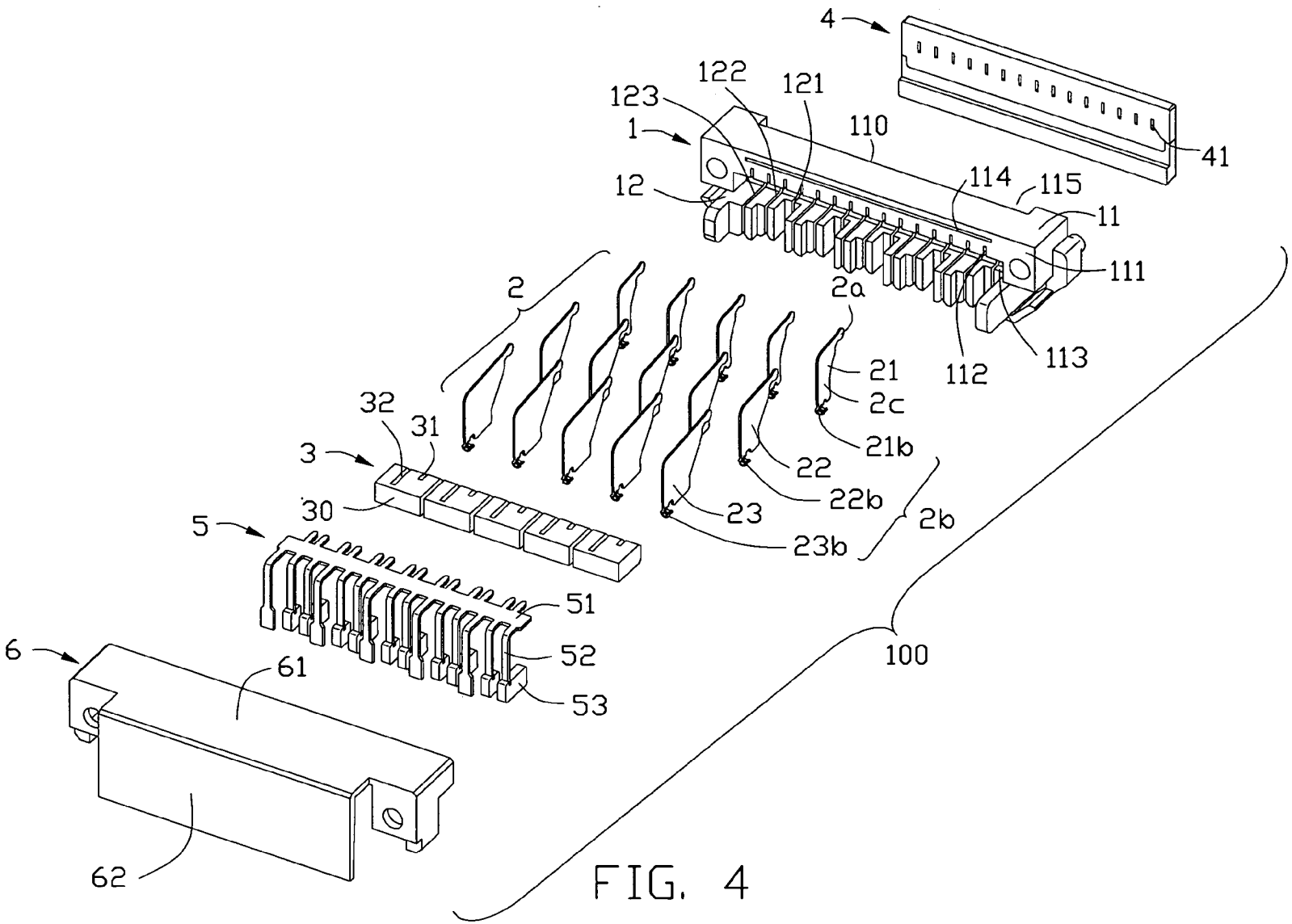
FIG. 4 is an exploded perspective view of the electrical connector shown in FIG. 3.
Figure 5:
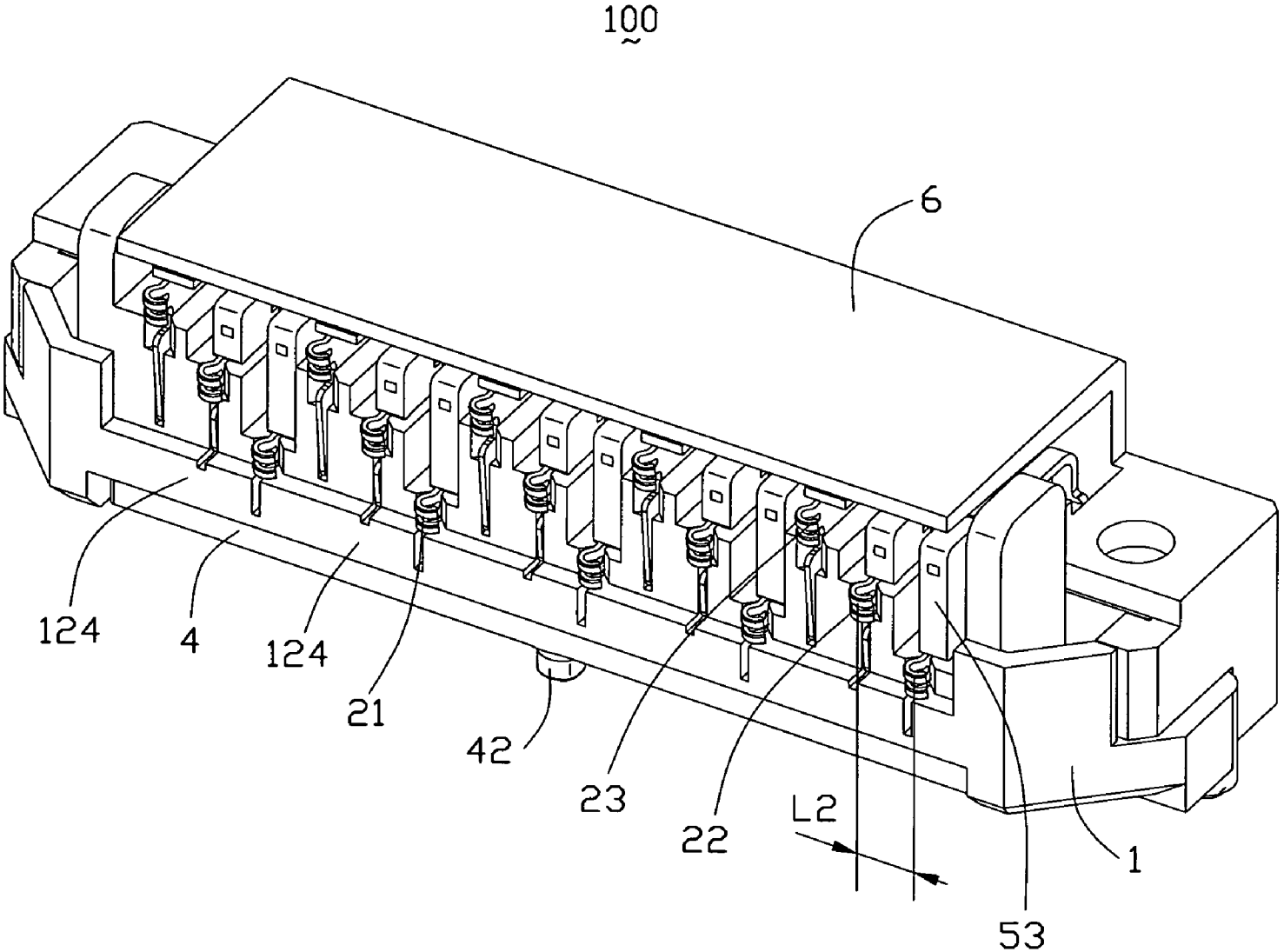
FIG. 5 is a partially assembled perspective view of the electrical connector shown in FIG. 4.
Figure 6:
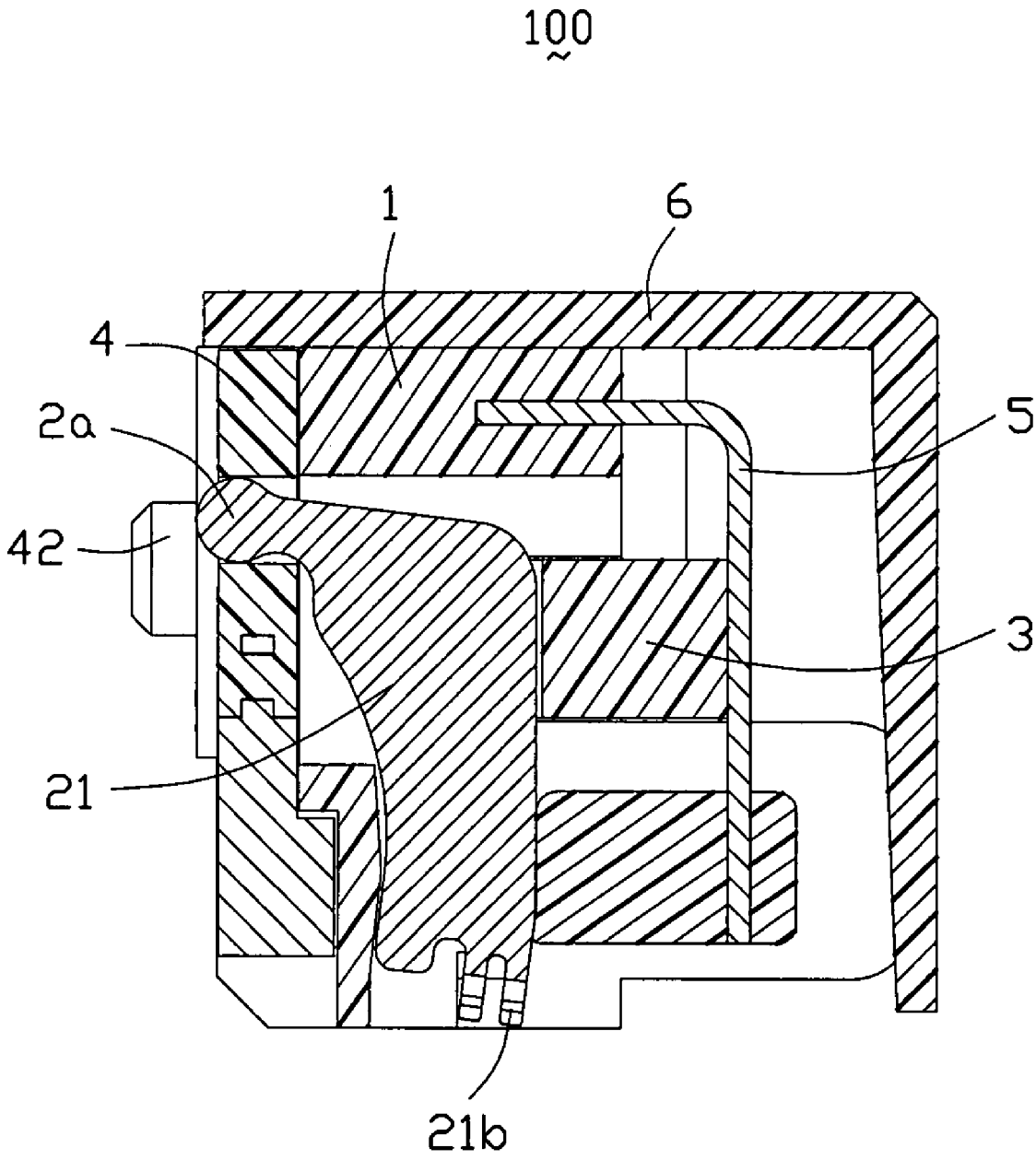
FIG. 6 is a cross-sectional view showing the first contacts mounted in the electrical connector shown in FIG. 4.
Figure 7:
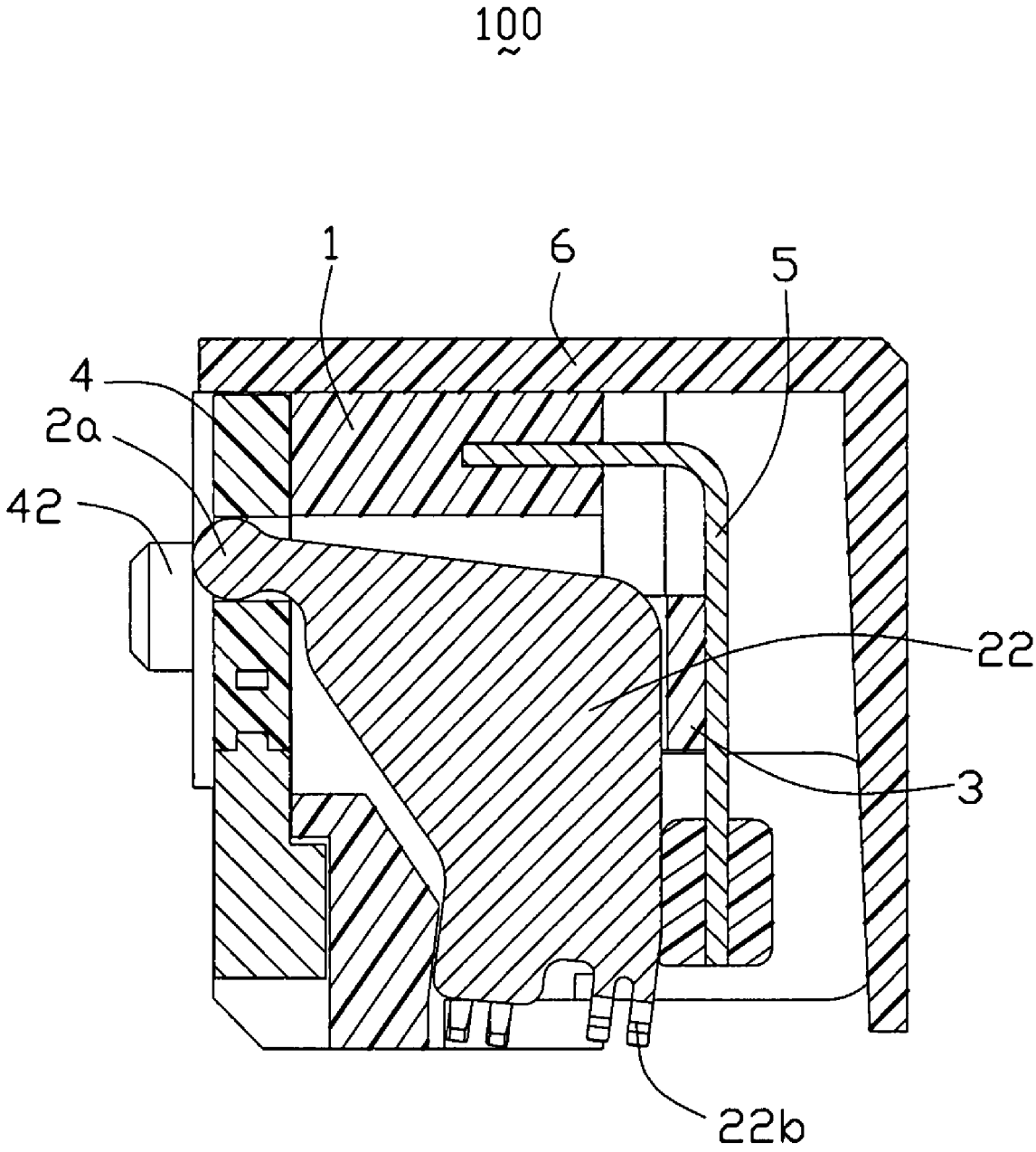
FIG. 7 is a view similar to FIG. 6, but showing the second contacts mounted in the electrical connector.
Figure 8:
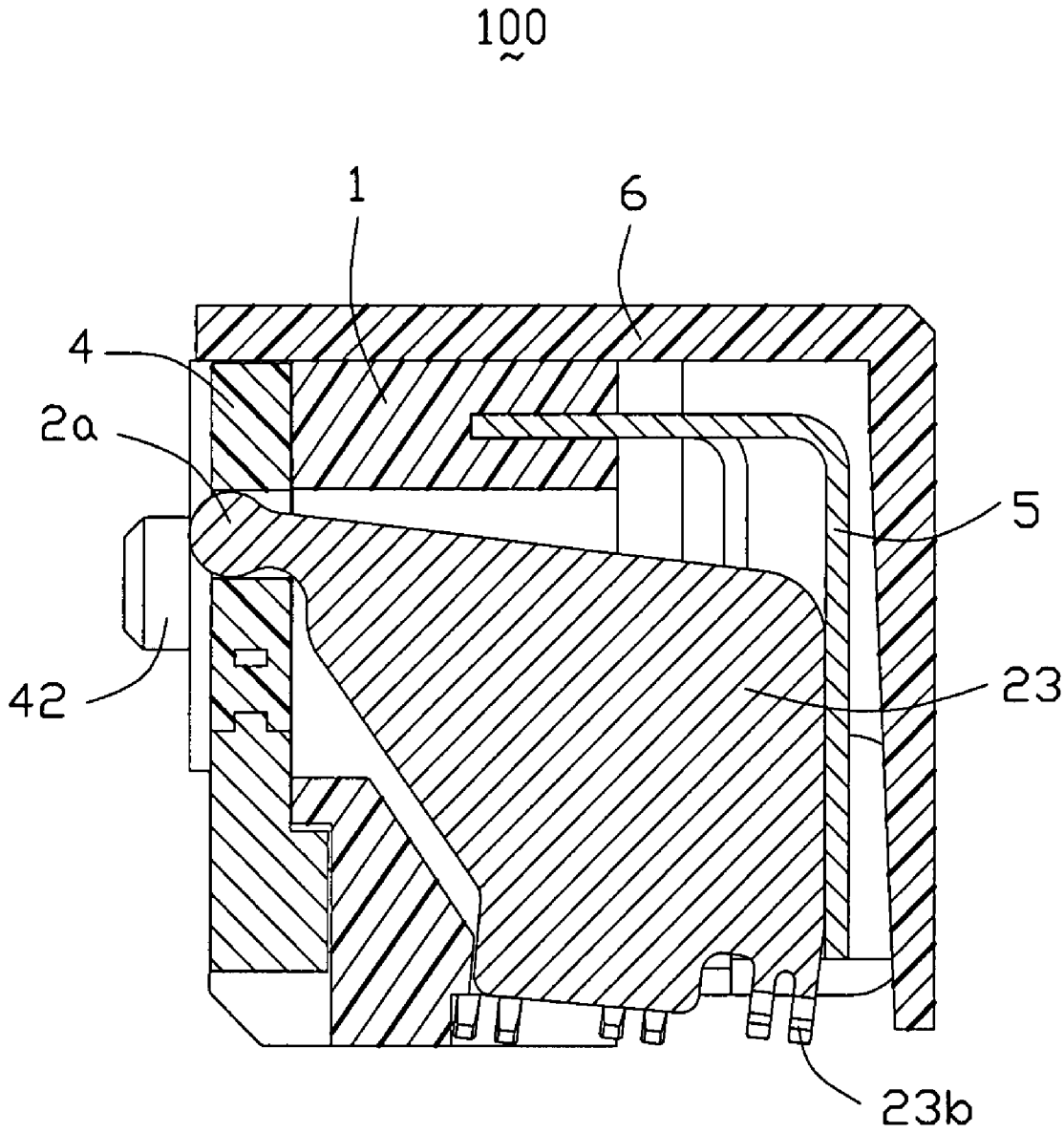
FIG. 8 is a view similar to FIG. 6, but showing the third contacts mounted in the electrical connector.
Figure 9:
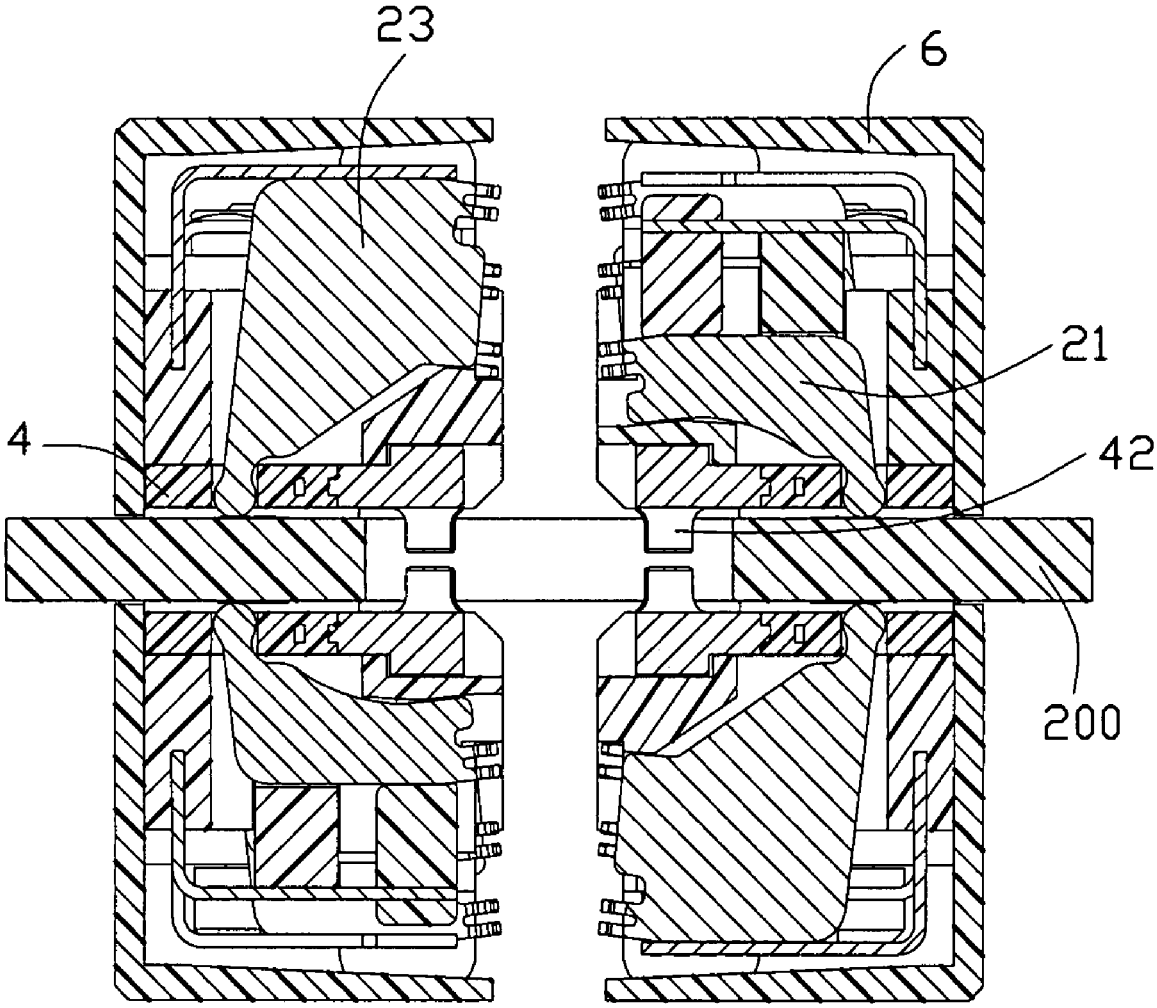
FIG. 9 is cross-sectional view showing the electrical connector connecting with the stationary card.
Figure 10:
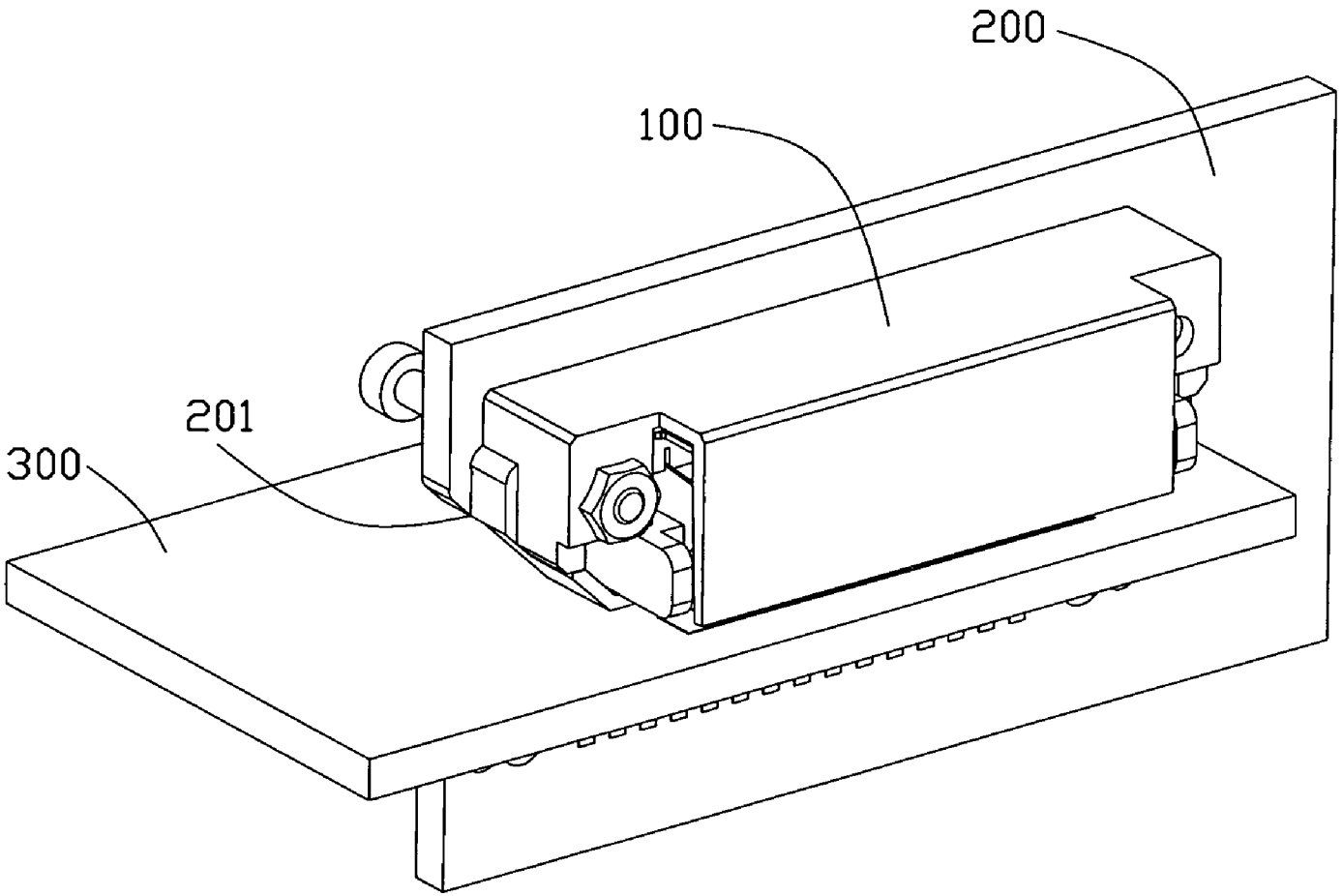
FIG. 10 is a perspective view of the electrical connector interconnecting the stationary card and the removable card.

Referring to FIG. 4, the insulative housing 1 comprises a body portion 11 having a front face 110 and an opposite rear face 111, and a tongue portion 12 disposed below the body portion 11. The body portion 11 has a depression 115 defined at the front face 110 thereof, a recess 114 defined at the rear face 111 thereof along a transverse direction, and a plurality of channels 112 extending throughout both the front face 110 and the rear face 111 along a longitudinal direction perpendicular to the transverse direction. The tongue portion 12 has a plurality of passageway groups defined thereon. In the preferred embodiment, each passageway group comprises a first through third passageways 121-123 having different lengths along the longitudinal direction and preferably aligned with corresponding channels 112 respectively. In each passageway group, the second passageway 122 is defined between the first and the third passageways 121, 123 and has a length longer than that of the first passageway 121, but shorter than that of the third passageway 123.

In the preferred embodiment, the plurality of contacts 2 comprises a plurality of first through third contacts 21-23. Each first through third contact 21, 22, 23 respectively has different length along the longitudinal direction. Each second contact 22 has a length longer than that of the first contact 21, but shorter than that of the third contact 23. Each contact 2 includes an engaging end 2*a* extending beyond the front face 110 and a contacting end 2*b* extending to a bottom face 124 of the tongue portion 12. The first through third contact 21-23 has a first through third paths (not labeled), along which current flows, defined between the first through third contacting end 21*b*-23*b* and corresponding engaging end 2*a*. The first through third paths respectively have equal lengths for transmitting corresponding current synchronously. The engaging end 2*a* is configured as a planar round head, while the contacting end 2*b* is configured to have a pair of bent fingers for wiping purpose during insertion of the removable card 300.

Understandably, configurations of the contacting ends 2*b* can be optionally selected during application. The contacting ends 2*b* comprise a first through third contacting ends 21*b*-23*b* respectively formed on the first through third contacts 21-23. Each contact 2 has an intermediate portion 2*c* configured as a planar plate connecting both the engaging end 2*a* and the contacting end 2*b*.

The spacer 3 comprises a plurality of base portions 30 configured as a rectangular block. In the preferred embodiment, each base portion 30 has a first and a second slot 31, 32 defined thereon along the longitudinal direction. The second slot 32 has a length longer than that of the first slot 31. Optionally, the plurality of base portions 30 can be integrally moldered as a single one.

The actuation plate 4 is configured as a rectangular plate and defines thereon an array of holes 41 extending throughout the actuation plate 4 and communicating with corresponding channels 112 for extension of corresponding round heads of the engaging ends 2*a*. The engaging ends 2*a* would move together with the actuation plate 4 during the insertion of the removeable card 300. The actuation plate 4 has a post 42 projecting forwardly from a front surface thereof. In the preferred embodiment, part of the actuation plate 4 is made from metal alloy for reinforcing itself. However, other variations of the actuation plate 4 which can engage and move together with the engaging ends 2*a* of the contacts 2 are also contemplated.

The biasing spring 5 comprises an anchor 51, a plurality of spring arms 52 extending downwardly from the anchor 51, and a plurality of insulators 53 respectively connecting with a free end of the spring arm 52. The insulator 53 can be integrally formed with the spring arm 52, or can be firstly molded and then assembled to the spring arm 52. Optionally, the anchor 51 could be divided into a plurality of anchor portions each connecting with a spring arm 52 according to the application requirement.

The shell 6 is made from insulative material and comprises a top wall 61 and a rear wall 62 perpendicular to the top wall 61.

Referring to FIGS. 3-8, in assembly of the electrical connector 100, the actuation plate 4 is firstly embedded into the depression 115. The contacts 2 are then inserted into the passageway groups, with the intermediate portions 2*c* of the first through third contacts 21-23 respectively retained in the first through third passageways 121-123, the contacting ends 2*b* exposed below the bottom face 124, and the engaging ends 2*a* extending beyond the front face 110 through the channels 112 and the holes 41. The contacting ends 21*b*-23*b* of the first through third contacts 21-23 are arranged in three transverse rows positioned along a front-to-back direction. Three rows of contacts 21-23 are offset from each other a second distance "L2" (FIG. 5) along the transverse direction, i.e., a cross connecting direction of the two boards 200 and 300.

The spacer 3 is attached to the body portion 11 rearwardly of the contacts 2 for keeping the contacts 2 in position, with the first and second slots 31, 32 thereof respectively receiving the first and the second contacts 21, 22. The third contact 23 is disposed between two adjacent base portions 30.

The biasing spring 5 is then assembled to the rear portion of the insulative housing 1, with the anchor 51 inserted into the recess 114, and the spacer 3 disposed between the contacts 2 and the spring arms 52. The insulators 53 of the biasing spring 5 abut against a rear portion of the tongue portion 12 for providing a biasing force to the contacting ends 2*b* of the contacts 2 to thereby hold the actuation plate 4 and the contacts 2 in position. The shell 6 is finally attached to the insulative housing 1, with the front wall 61 covering a top portion of the insulative housing 1, and the rear wall 62 disposed behind the biasing spring 5.

Referring to FIGS. 10-13, the stationary card 200 has a cutout 201 defined thereon and a plurality of conductive pads (not shown) formed thereon. The removable card 300 is provided with one cam member 301 on each surface thereof, which together with the post 42 of actuation plate 4 forms an actuator 400 (FIG. 13) for facilitating the electrical connection between the two cards 200, 300. The cam member 301 defines thereon a slot 302 opened toward the stationary card 200 and a mating edge 307 (FIG. 11) of the removable card 300. The slot 302 is defined in such a shape that, when the removable card 300 is inserted toward the stationary card 200 and received in the cutout 201, the post 42 of the actuation plate 4 slides within the slot 302 and moves close to the removable card 300. The cam member 301 is secured on the removable card 300 by a screw 303. Understandably, other structures or elements or methods are also applicable for firmly assembling the cam member 301 on the removable card 300. Additionally, a single integral cam member may be provided instead of two cam members (one on each side of the card).

Figure 11:
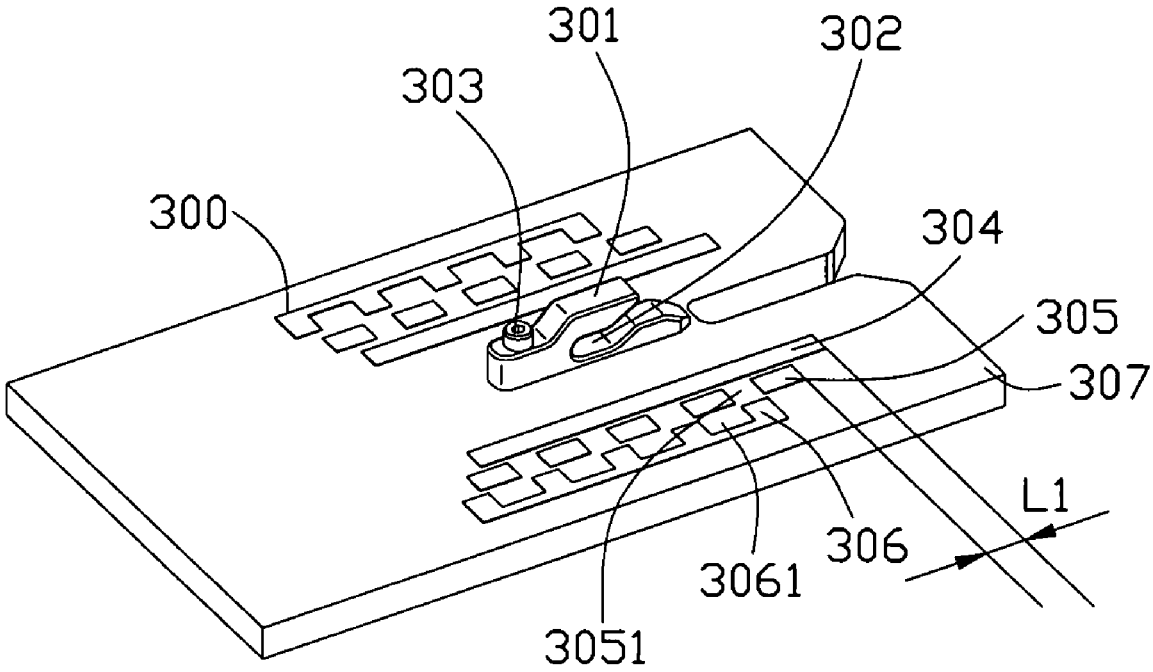
FIG. 11 is a perspective view of the removable card.

Referring to FIG. 11, the removable card 300 has two groups of first through third transverse rows of conductive pads 304-306 symmetrically formed beside the cam member 301. The second row of conductive pads 305 are offset from the first row of conductive pads 304 along the transverse direction a first distance "L1" greater than the second distance "L2". The third row of conductive pads 306 are offset from the second row of conductive pads 305 along the transverse direction a third distance (not labeled) greater than the first distance "L1". The first contact pad 304 is disposed closest to the mating edge 307 of the removable card 300, and the third contact pad 306 is most far away from the mating edge 307. The second and the third rows of conductive pads 305, 306 are at least partially non-continuous and respectively have a plurality of second and third spaces 3051, 3061 defined thereon. The first contact pads 304 can be suitably arranged as a continuous row, i.e., the contacts pads 304 are interconnected.

When the actuation plate 4 is driven to move transversely toward the removable card 300 along the front face 110 of the insulative housing 1, the engaging ends 2*a* of the contacts 2 are moved transversely with the actuation plate 4, while the contacting ends 2*b* of the contacts 2 have a pivotal movement and move away from the stationary card 200. The pivotal movement of the first and second contacting ends 21*b*, 22*b* of the first and second contacts 21, 22 are confined by the spacer 3, due to the engagement between the spacer 3 and the body portion 11. As mentioned above, the biasing spring 5 provides a biasing force to the contacts 2. When the contacts 2 are moved with the actuation plate 4, the engaging ends 2*a* and the contacting ends 2*b* of the contacts 2 provide a wiping contact with respect to corresponding conductive pads of the stationary card 200 and the removable card 300.

The connectors 1 are securely mounted on the stationary card 200 with the engaging ends 2*a* of the contacts 2 electrically contacting with the conductive pads of the stationary card 200. In this position, the spring arms 52 are substantially parallel to the stationary card 200.

Referring to FIGS. 10-13, when the mating edge 307 of the removable card 300 is inserted into the cutout 201 of the stationary card 200 along the transverse direction, the post 42 of the actuation plate 12 is engaged with the cam member 301 and moves along the slot 302. With the sliding movement of the post 42 in the slot 302, the post 42 moves close to the removable card 300 and the actuation plate 4 is driven to move transversely along the front face 110 of the insulative housing 1. The engaging ends 2*a* of the contacts 2 move together with the actuation plate 4 and slide on corresponding conductive pads of the stationary board 200.

Figure 12:
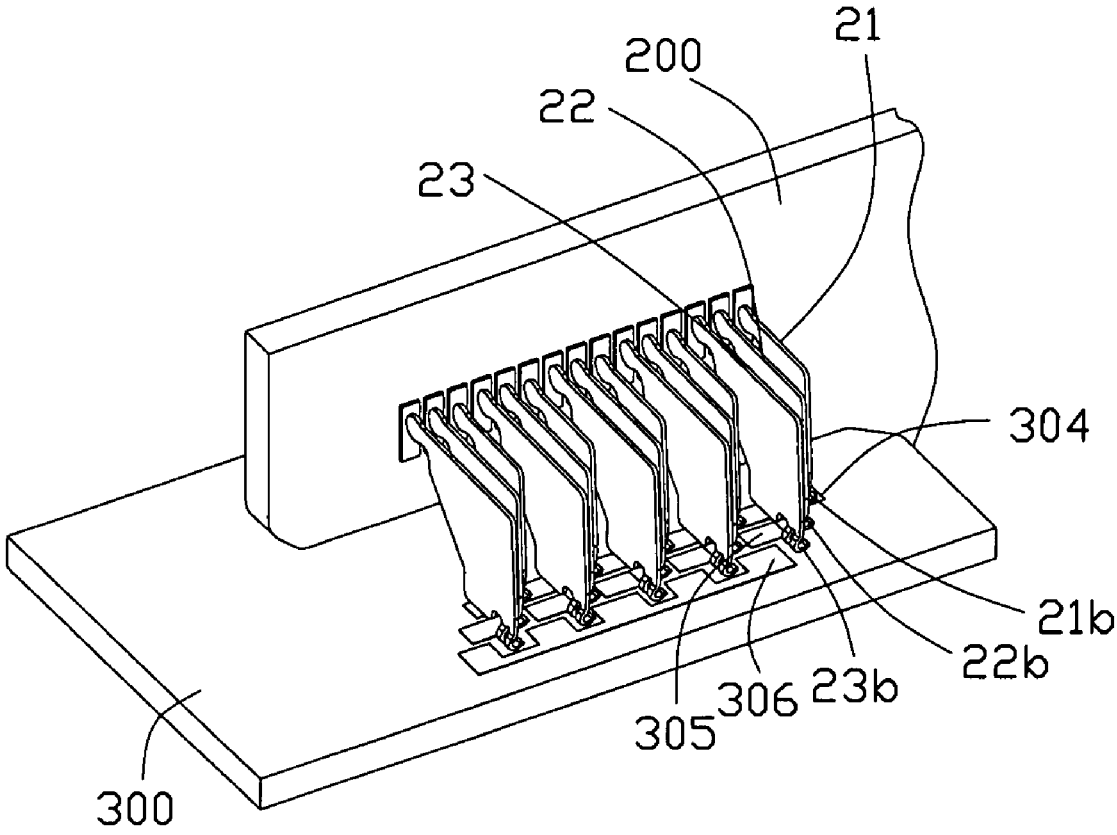
FIG. 12 is perspective view showing the engagement between the removable card and the contacts mounted on the stationary card.
Figure 13:
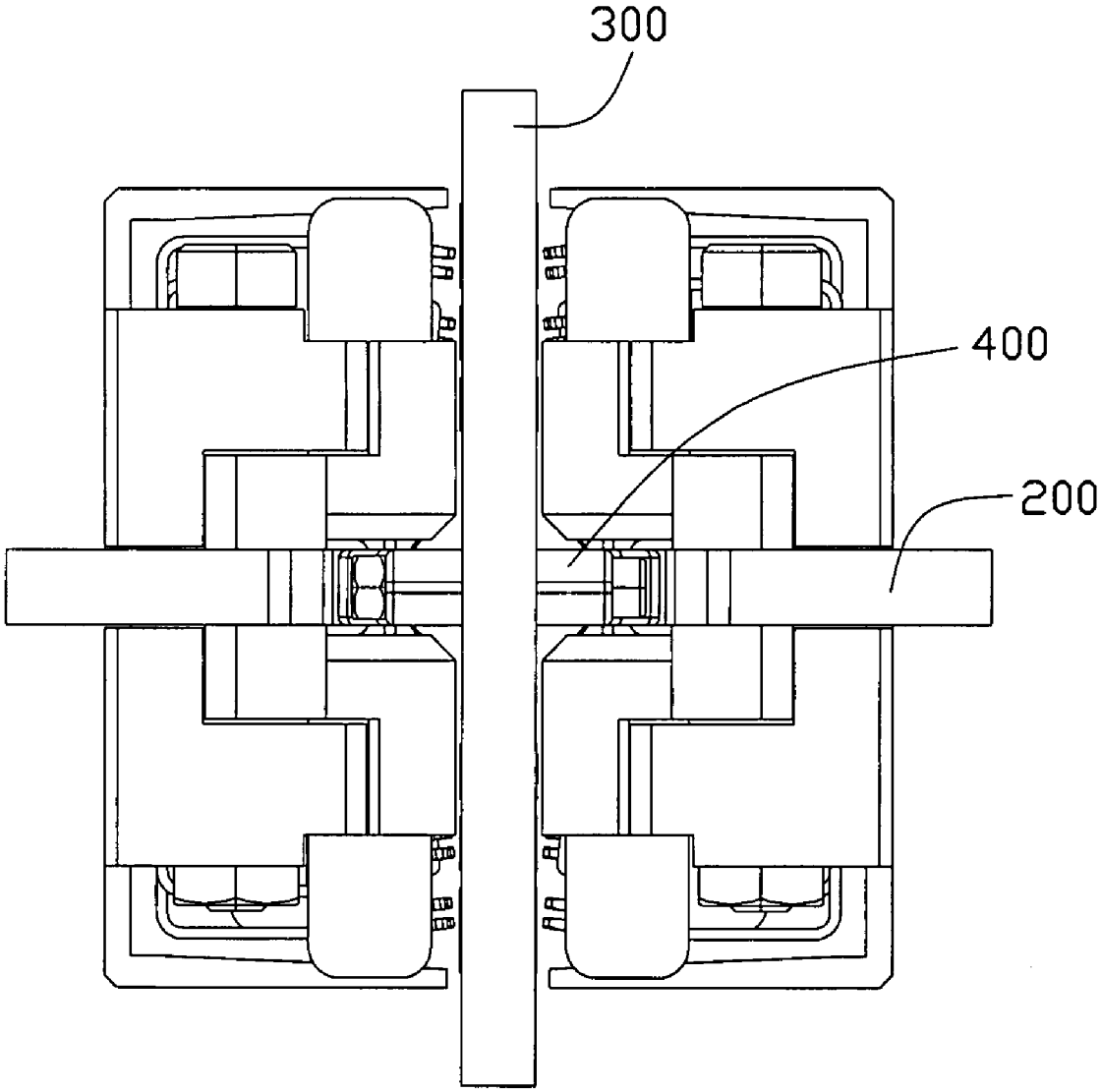
FIG. 13 is a cross-sectional view similar to FIG. 10.

The first through third contacting ends 21*b*-23*b* of the first through third contacts 21-23 arranged in three transverse rows come to contact with the first through third rows of conductive pads 304-306, respectively. Referring to FIGS. 11-12, the first contacting ends 21*b* of the first contacts 21 are moved transversely to contact with corresponding first transverse row of conductive pads 304 of the inserted removable card 300 firstly for electrostatic discharging, with the second and third contacting ends 22*b* and 23*b* being not in contact with the second and third rows of conductive pads 305 and 306. Secondly, the second contacting ends 22*b* come to contact with corresponding second row of conductive pads 305 of the inserted removable card 300 for grounding, with the third contacting ends 23*b* being not in contact with the third conductive pads 306. Thirdly, the third contacting ends 23*b* come to contact with corresponding third conductive pads 306 of the inserted removable card 300 for transmitting power signals. Therefore, different types of signals are transmitted in sequence. It is noted that one or more of either the second conductive pads 305 or the third conductive pads 306 or both may be partially interconnected. FIG. 11 shows such an arrangement for the third conductive pads 306.

The first through third paths of the first through third contacts 21-23 respectively have equal lengths for distributing corresponding signal in synchronization.

In this embodiment, the first through third contacting ends 21*b*-23*b* are offset the second distance from each other, while the first through third conductive pads 304-306 are offset from each other the first distance greater than the second distance.

In the preferred embodiment, the first through third contacting ends 21*b*-23*b* of the first through third contacts 21-23 are employed to transmit electrostatic discharge signals, grounding and power signals in sequence. Understandably, when the system does not need to perform electrostatic discharge, the first contacts 21 could be removed from the electrical connector 100. Similarly, when the connector 100 needs to transmit more than three types of signals, an additional row of contacts may be employed.

Understandably, when the system need to transmit more than two types of signals, the system comprises adequate connectors each having a plurality of contacts. Either offsetting the connectors or offsetting corresponding conductive pads to permit the contacts to transmit corresponding signals in sequence.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical interconnection system comprising:

a first printed circuit board;

a second printed circuit board for cross connecting with the first printed circuit board, the second printed circuit board having a first row of conductive pads and a second row of conductive pads along a cross connecting direction of the two boards, the first and second rows of conductive pads being offset a first distance from each other along the cross connecting direction; and a connector mounted on the first board and actuatable to effectuate an electrical connection between the two boards, the connector comprising an insulative housing defining a plurality of passageways and a plurality of contacts inserted in corresponding passageways, the contacts comprising a plurality of first contacts each having a first contacting end arranged in a row along the cross connecting direction and a plurality of second contacts each having a second contacting end arranged in a row along the cross connecting direction, the two rows of first and second contacting ends being offset along the cross connecting direction a second distance shorter than the first distance, the row of first contacting ends being in contact with the first row of conductive pads prior to the row of second contacting ends being in contact with the second row of conductive pads, when the second printed circuit board is cross connected to the first printed circuit board.

2. An electrical interconnection system as described in claim 1, wherein each contact has an engaging end contacting with the first printed circuit board, and wherein the first contact has a first path defined between the first contacting end and corresponding engaging end, and the second contact has a second path defined between the second contacting end and corresponding engaging end.

3. An electrical interconnection system as described in claim 2, wherein said first and said second paths respectively have equal length, and said passageways comprises a plurality of first and second passageways receiving the first and second contacts respectively.

4. An electrical interconnection system as described in claim 1, wherein said plurality of contacts comprise a plurality of third contacts having a plurality of third contacting ends arranged in a row offset from the row of second contacting ends the second distance, and wherein the second printed circuit board comprises a third row of conductive pads offset from the second row of conductive pads a third distance along the connecting direction greater than the first distance, the row of third contacting ends being in contact with the third rows of conductive pads after the row of second contacting ends are in contact with the second row of conductive pads.

5. An electrical interconnection system as described in claim 4, wherein each third contact comprises a third engaging end and a third path formed between the third contacting end and the third engaging end, said third paths having equal length, and wherein said passageways comprise a plurality of third passageways receiving the third contacts.

6. An electrical interconnection system as described in claim 5, wherein said second and third conductive pads have a plurality of spaces defined thereon, respectively.

7. An electrical interconnection system as described in claim 5, wherein said second contact is positioned between the first contact and the third contact, and the second path is longer than the first path, but shorter than the third path.

8. An electrical interconnection system as described in claim 1, wherein the connector comprises an actuation plate receiving respective engaging ends of the contacts disposed opposite to the contacting ends thereof, and wherein the second printed circuit board comprises a cam member for urging the actuation plate to electrically interconnect the first and the second printed circuit board.

9. An electrical interconnection system as described in claim 8, wherein said insulative housing comprises a body portion, and said body portion defines thereon an array of channels extending throughout the body portion along a longitudinal direction for extension of the engaging ends of the contacts.

10. An electrical interconnection system as described in claim 9, wherein the actuation plate is mounted on the body portion and defines an array of holes communicating with corresponding channels.

11. An electrical interconnection system as described in claim 10, wherein said actuation plate comprises a post projecting forwardly from a front face thereof.

12. An electrical interconnection system as described in claim 10, further comprising a resilient portion having an anchor, wherein said body portion has a recess defined at a rear face thereof along a transverse direction perpendicular to the longitudinal direction for insertion of the anchor.

13. An electrical interconnection system as described in claim 12, wherein said resilient portion comprises a plurality of spring arms extending downwardly from the anchor and a plurality of insulators providing a biasing force to the engaging ends of the contacts to thereby hold the actuation plate and the contacts in position.

14. An electrical interconnection system as described in claim 12, further comprising a plurality of spacers mounted between the contacts and the resilient portion for keeping the contacts in position and confining a movement of the contacts.

15. An electrical interconnection system as described in claim 1, further comprising a shell assembled to the insulative housing.

16. An electrical connection system comprising:

a stationary printed circuit board defining a first edge;

a removable printed circuit board defining a second edge under a condition that the first edge and the second edge are closely parallel to each other while the first printed circuit board and the second circuit board are perpendicular to each other;

an electrical connector located around an intersectional corner area where said first edge and said second edge extend, and fastened to the stationary printed circuit board, said connector defining a first mating face confronting the stationary printed circuit board and a second mating face confronting the removable printed circuit board;

the connector comprising a plurality of contacts each with first and second contacting ends moveable around the first mating face and the second mating face, respectively;

an actuator being associated with the connector; and intereengagement means formed on the actuator and the removable printed circuit board so as to have the first contacting end and the second contacting end respectively mechanically and electrically engage the stationary printed circuit board and the removable printed circuit board when the removable printed circuit board approaches the stationary printed circuit board under a condition that the second edge approaches the first edge along a linear direction of said second edge.

17. The interconnection system as claimed in claim 16, wherein the first edge is formed in a first slit of the stationary printed circuit board, and the second edge s formed in a second slit of the removable printed circuit board, wherein the stationary printed circuit board and the removable printed circuit board are interwoven with each other under a condition that a portion of the stationary printed circuit board is received in the second slit and the removable printed circuit board is received in the first slit.

18. The interconnection system as claimed in claim 16, wherein the second contacting ends of said contacts are arranged in two rows along a longitudinal direction of the connector, which mechanically and electrically engage the removable printed circuit board in sequence but not simultaneously, according to which row said second contacting ends belong to.

19. The interconnection system as claimed in claim 18, wherein sequential engagement between two rows of the second contacting ends and the removable printed circuit board results from different distances between the second contacting ends and the second edge.

20. An interconnection system comprising:

a stationary printed circuit board defining a first edge;

a removable printed circuit board defining a second edge under a condition that the first edge and the second edge are closely parallel to each other while the first printed circuit board and the second circuit board are perpendicular to each other;

an electrical connector located around an intersectional corner area where said first edge and said second edge extend, and fastened to the stationary printed circuit board, said connector defining a first mating face confronting the stationary printed circuit board and a second mating face confronting the removable printed circuit board;

the connector comprising a plurality of contacts each with first and second contacting ends moveable around the first mating face and the second mating face, respectively; and an actuator being associated with the connector to urge the second contacting ends mechanically and electrically to engage the removable printed circuit board; wherein the second contacting ends of said contacts are arranged in two rows along a longitudinal direction of the connector, which mechanically and electrically engage the removable printed circuit board in sequence but not simultaneously, according to which row said second contacting ends belong to.

* * * * *